US008474666B2

(12) United States Patent
Vitillo et al.

(10) Patent No.: US 8,474,666 B2
(45) Date of Patent: Jul. 2, 2013

(54) ANKLE FOOT ORTHOSIS AND SHOE DONNING DEVICE

(76) Inventors: Diane Vitillo, Kendall Park, NJ (US); Nicholas Vitillo, Kendall Park, NJ (US)

( * ) Notice: Subject to any disclaimer, the term of this patent is extended or adjusted under 35 U.S.C. 154(b) by 64 days.

(21) Appl. No.: 13/248,341

(22) Filed: Sep. 29, 2011

(65) Prior Publication Data

US 2013/0082076 A1 Apr. 4, 2013

(51) Int. Cl.
*A47G 25/80* (2006.01)
*A47G 25/00* (2006.01)

(52) U.S. Cl.
USPC ..... 223/113

(58) Field of Classification Search
USPC ..... 223/111–119
See application file for complete search history.

(56) References Cited

U.S. PATENT DOCUMENTS

| | | | | |
|---|---|---|---|---|
| 8,865 | A * | 4/1852 | Thomson | 223/117 |
| 4,683,876 | A | 8/1987 | Changras | |
| 4,908,897 | A * | 3/1990 | Sadlak | 12/123 |
| 5,593,071 | A | 1/1997 | Lusk | |
| 6,102,262 | A * | 8/2000 | Nicholson | 223/112 |
| 6,145,931 | A | 11/2000 | Subotic | |
| 6,173,511 | B1 | 1/2001 | Perrault | |
| 6,409,692 | B1 | 6/2002 | Covey | |
| 6,932,252 | B2 | 8/2005 | Simmons | |
| 8,083,110 | B2 * | 12/2011 | Wilkens | 223/111 |
| 8,356,735 | B1 * | 1/2013 | Drakeford | 223/112 |
| 2006/0020233 | A1 * | 1/2006 | Bremer | 602/23 |
| 2006/0027612 | A1 * | 2/2006 | Boaron | 223/111 |

* cited by examiner

*Primary Examiner* — Ismael Izaguirre

(57) ABSTRACT

An ankle foot orthosis (AFO) and shoe donning device is disclosed comprising an L-shaped AFO cradle with unitarily formed hinge pins for releasable and rotatable engagement with channels in a docking base for purposes of stabilizing and positioning an AFO for donning by a patient with restricted movement. The AFO cradle can be rotated in a variety of positions within the docking base for donning an AFO using only one hand at a position of choice. A shoe platform is also provided for engagement with the docking base in which includes an inclined upper surface for placement of a shoe and which is designed for releasable engagement with the docking base and with the AFO cradle to stabilize the shoe platform during donning of a shoe. Adjustable pins are provided to accommodate various AFO and shoe sizes during the donning process.

20 Claims, 16 Drawing Sheets

ANKLE FOOT ORTHOSIS AND SHOE DONNING DEVICE

FIELD OF THE INVENTION

The present invention relates in general to orthopedic device guides, and more specifically to an apparatus for aiding a person with impaired movement on one side of his or her body to don an ankle foot orthosis and a shoe using one hand.

BACKGROUND OF THE INVENTION

An Ankle Foot Orthosis, an AFO, is a medical device worn on the lower leg and foot to support the ankle and to hold the foot and ankle of a person, with impaired control on one side of his or her body, in the correct position to prevent drop-foot, a condition where the muscle that controls ankle dorsiflexion is too weak to raise the forefoot off the floor. A person who experiences a cerebral vascular accident, CVA, commonly referred to as a stroke, many times will afterward have a condition known as foot drop because one side of the person's body is affected either by weakness or paralysis resulting from the stroke. Because of the resultant lower extremity weakness or paralysis, the client is unable to independently maintain his or her foot in an appropriate position for a normal gait pattern. If the foot and ankle joint cannot be maintained in an appropriate position, at an angle of approximately 90 degrees when standing, the person cannot move his or her foot sufficiently to clear the surface of the floor during the swing phase of the gait cycle, thus creating a risk of falling. An AFO is typically prescribed to be worn by such a patient to maintain the appropriate foot and ankle position to facilitate a safe swing phase of the gait cycle thus reducing the risk of falls.

An AFO is commonly worn inside the shoe. Donning the AFO and shoe is quite problematic for a person with hemiplegia, total paralysis of the arm, leg and trunk on the same side of his or her body. That is also true for a sufferer of hemiparesis, marked weakness in one half of the body, impaired motor control and/or coordination, as well as for a person experiencing difficulty flexing his or her trunk due to various medical conditions or contraindications, for example hip precautions and thoracic and lumbar spinal precautions among other things.

The difficulty in donning an AFO on a lower extremity that is paralyzed or extremely weak while using only one hand arises because the patient requires the use of two hands to do so—one to hold the AFO steady and one to lift the affected lower extremity (leg) into it. At this time, a caregiver must be available to assist the client with donning the AFO. If a patient cannot don the AFO, he or she will not be able to safely ambulate (walk) within his or her environment, thus limiting his or her ability to participate in the daily activities of life.

Other AFO donning devices that are available to such patients do not provide an apparatus that allows a patient to stabilize and position an AFO and shoe in such a manner that a person can lift up his or her leg by the arm on the opposite side of the paralyzed side, usually by firmly grasping the pants or socks, and to place it into the AFO or shoe efficiently and safely. Other AFO donning devices do not provide for donning of an AFO at a variety of angles so that a patient can best choose which position he or she finds easiest to don the AFO. Other AFO donning devices also do not provide for the ability to don a patient's shoe by docking and stabilizing the shoe at an angle at which the patient can lift up his or her leg by the opposite agile arm.

SUMMARY OF THE INVENTION

The present invention overcomes the disadvantages and shortcomings of the problems of the prior art by providing an AFO and shoe donning apparatus that allows a person with restricted movement on one side of his or her body to lift and place his or her paralyzed leg into the AFO or shoe by the opposite non-paralyzed arm easily and safely.

It is the object of the present invention to provide a solution to the problem of inability of a patient to don an AFO or shoe by taking a new approach to the design and construction of an AFO/shoe donning device using lightweight materials, with easily positioning parts.

In a preferred version of the present invention, the apparatus is comprised of a docking base that is unitarily molded to releasably and rotatably receive an AFO cradle and shoe platform. The AFO docking base assembly provides a stable surface for placement of an AFO into the AFO cradle for the donning of a lower extremity into the AFO such that the AFO remains in an essentially static position to allow a patient to don it easily using only one hand.

According to the invention there is also provided an AFO cradle that is essentially L-shaped with an inner concave surface for reception of the convex surface of the AFO itself, the rear of which is substantially planar to allow it to lie flat within the stabilizing docking base. The AFO cradle is also formed into a non-slip surface with two releasably engaged pins that slidingly engage with the bottom surface of an AFO to accommodate various AFO widths. The AFO cradle is unitarily molded to include two stabilizing pins which fit into channels of the docking base which act as hinges so that the AFO cradle can rotate in the docking base in such a manner that the AFO cradle can be positioned to be essentially 90 degrees with respect to the docking base or essentially parallel to the docking base, allowing it to lie flat within the docking base when the shoe platform is not also being used. In this manner, a patient can don an AFO in a short sitting position or from a long sitting position respectively. When the shoe platform is also in position, the AFO cradle can be positioned at essentially a 45 degree angle with respect to the docking base providing for yet another position in which the person may don the AFO.

According to a second aspect of the invention there is provided a shoe platform that is also releasably engaged with the docking base. The shoe platform is designed to releasably fit into a second channel of the docking base and to rest against a correspondingly designed receiving channel of the AFO cradle. When the shoe platform rests against the AFO cradle it is prevented from being unintentionally pushed or rotated away from the patient during the shoe donning process. The shoe platform is designed with an angled upper surface that best allows a patient to place his shoe into the shoe platform, and then to lift his paralyzed leg by his opposite arm into the shoe in the easiest and safest manner. The shoe platform preferably also contains a channel for engagement with adjustable pins that can slide within the a slot in the channel to accommodate various shoe sizes.

According to a third aspect of the invention, there is provided an AFO and shoe donning device assembly manufactured from a light weight material so that a patient with impaired movement on one side can easily lift the assembly with one hand and/or arm. Such materials may include but are not limited to light weight plastics, polymers and the like.

BRIEF DESCRIPTION OF THE DRAWINGS

For a more complete understanding of the present invention, reference is made to the following detailed description of the exemplary embodiment(s) considered in conjunction with the accompanying drawing in which.

DETAILED DESCRIPTION OF THE EXEMPLARY EMBODIMENTS

Figure 1:
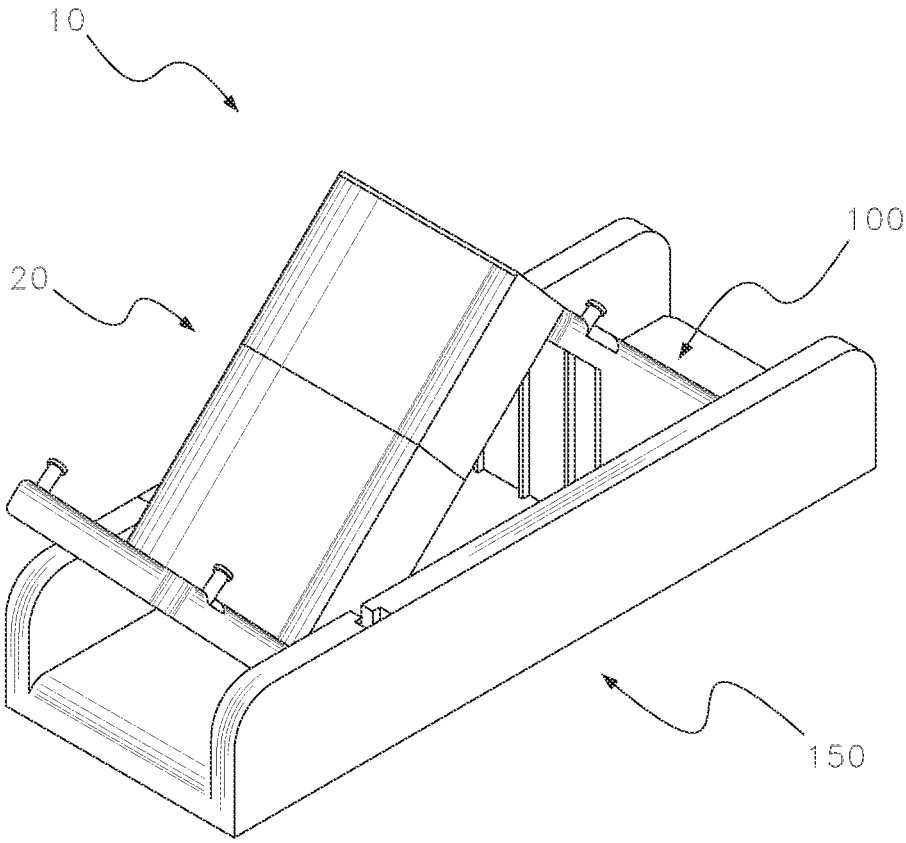
FIG. 1 is a perspective view of the AFO and shoe donning device assembly shown from the front of the device assembly.
Figure 2:
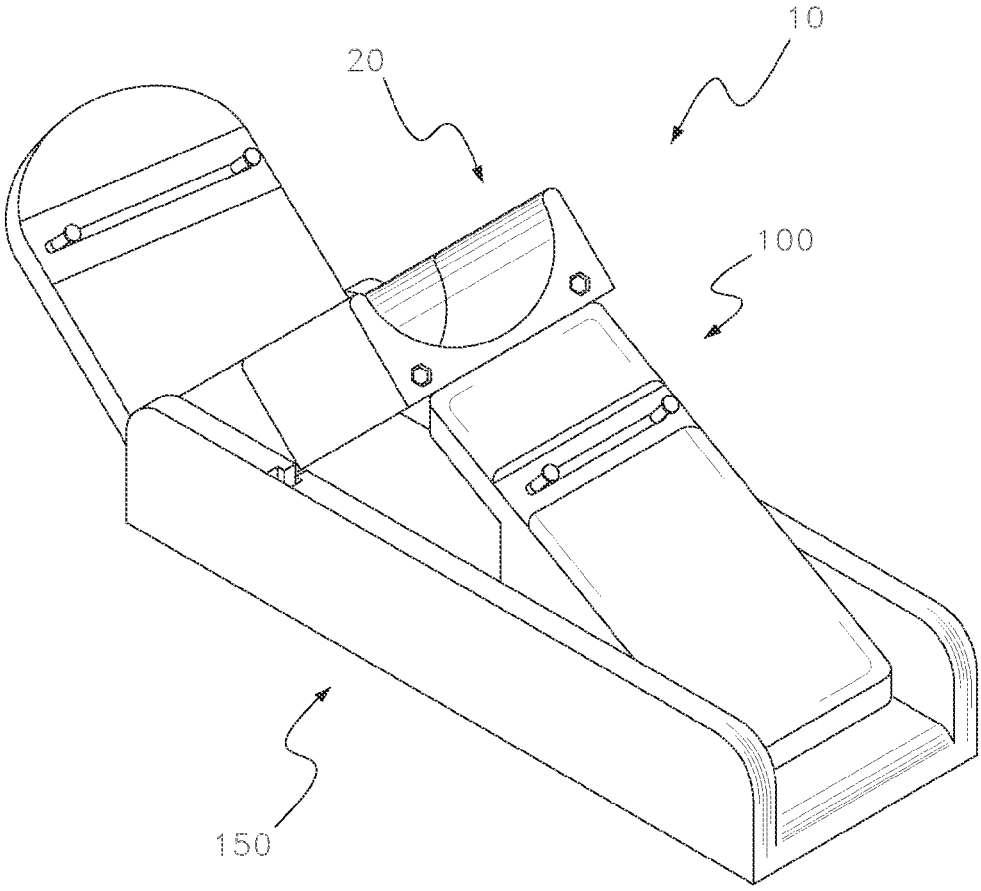
FIG. 2 is a perspective view of the AFO and shoe donning device assembly of FIG. 1 shown from the rear of the device assembly.

Referring to FIGS. 1-2, an AFO and shoe donning device assembly 10, constructed in accordance with the present invention, is shown to include an AFO cradle 20, a shoe platform 100, and a docking base 150.

Figure 3:
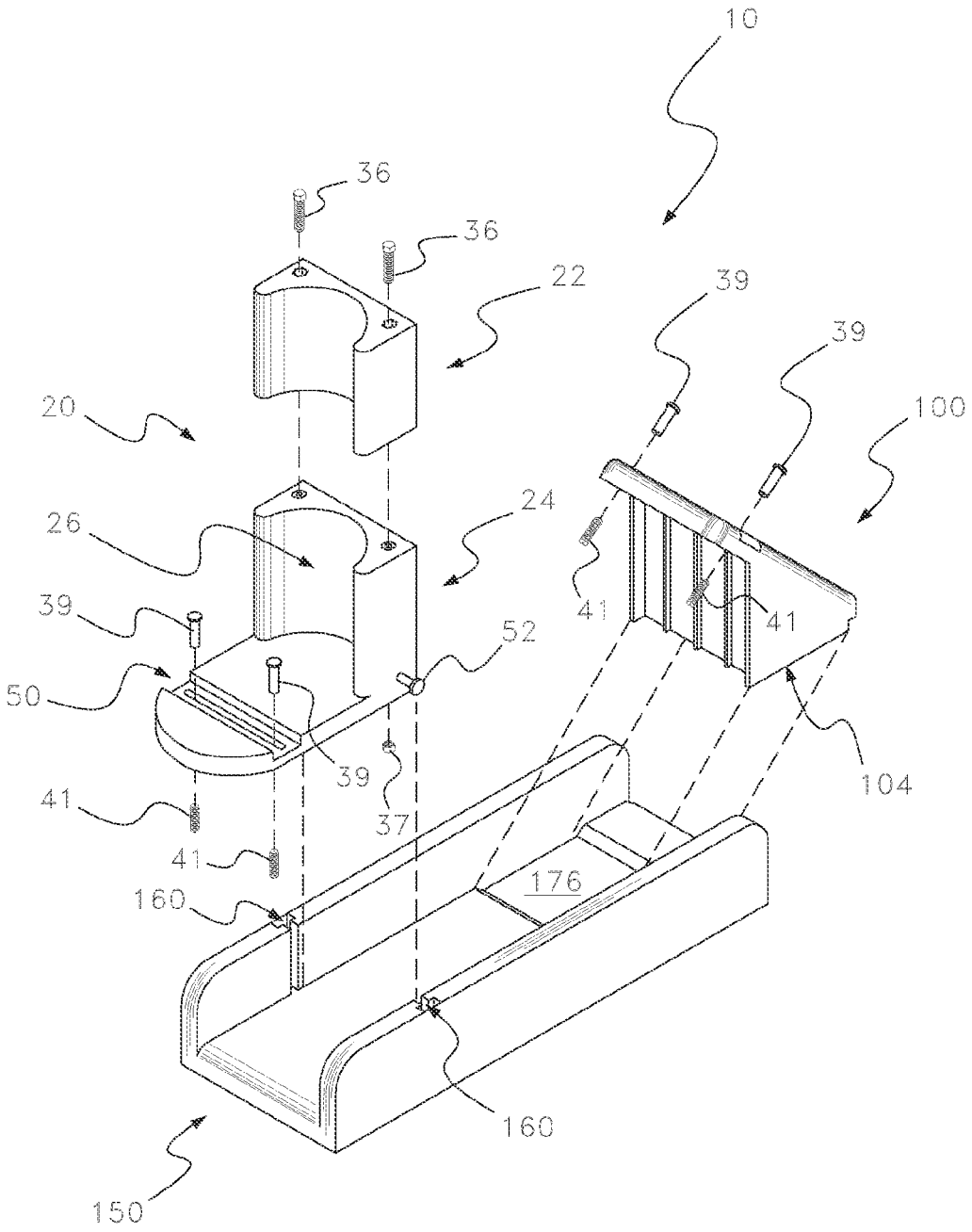
FIG. 3 is an exploded perspective view of the AFO and shoe donning device assembly of FIG. 1 shown from the front of the device assembly.

As can be more clearly seen in FIG. 3, the AFO cradle 20 slidingly and pivotably engages with specially formed hinge channels 160 configured in the docking base 150 by means of AFO cradle hinge pins 52. In the preferred embodiment, the AFO cradle hinge pins 52 are unitarily molded on the opposite sides of the AFO cradle 20, but it should be understood that the AFO cradle hinge pins 52 could alternatively be designed as threaded pins to fit into threaded holes. The bottom surface 104 of the shoe platform 100 releasably engages with a specially formed shoe platform channel 176 of the shoe platform 100. When assembled, the AFO cradle 20 and the shoe platform 100 are designed to also engage with each other to prevent sliding of the shoe platform 100 with respect to the docking base 150 for stability during shoe donning, and to also provide for a stable and an essentially 45 degree angled positioning of the AFO cradle 20 for donning an ankle foot orthosis from a short seated position.

Figure 9:
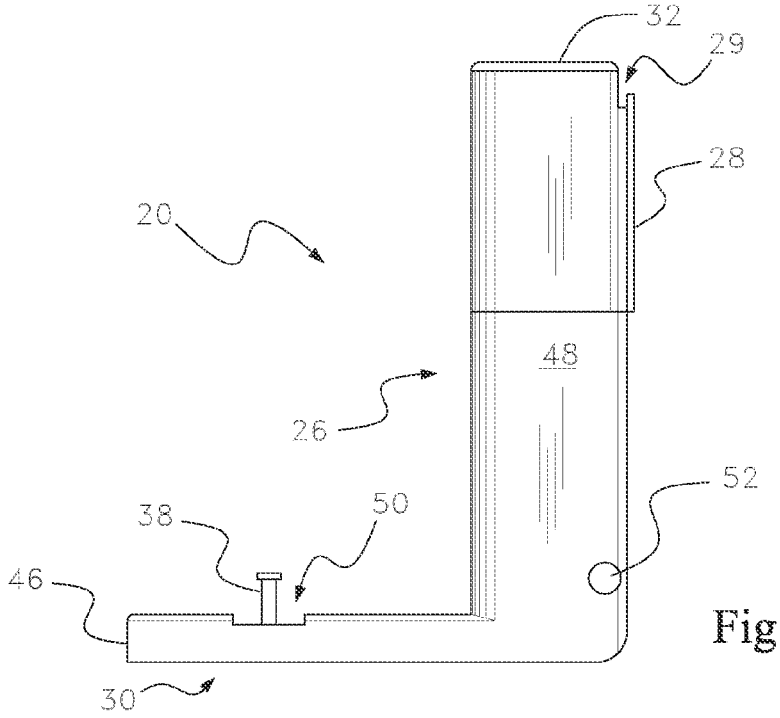
FIG. 9 is a right side elevational view of the AFO cradle.
Figure 10:
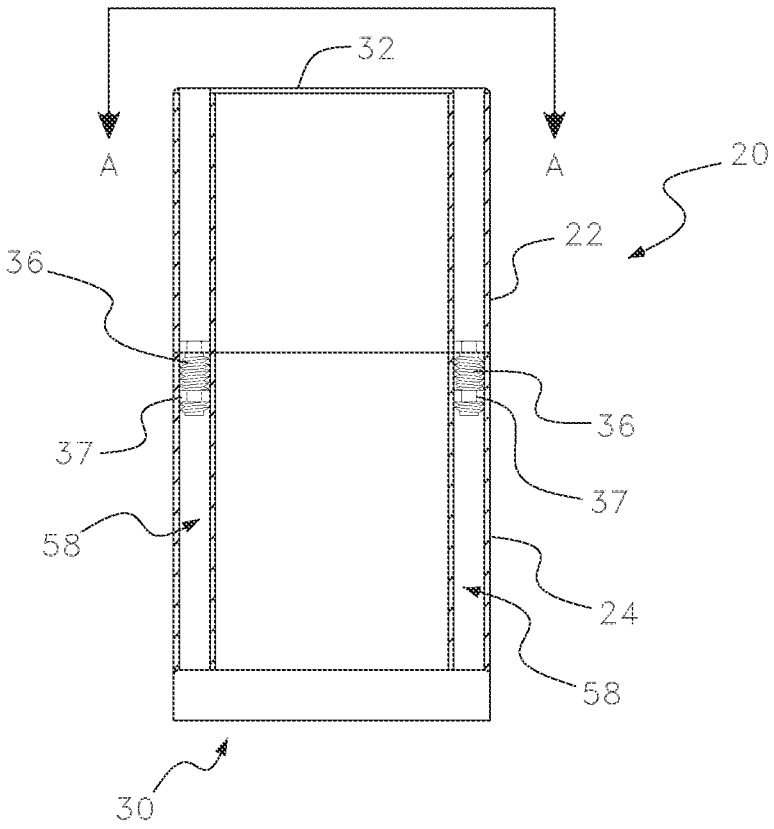
FIG. 10 is a cross sectional view taken through line AA of FIG. 6 of the AFO cradle.
Figure 11:
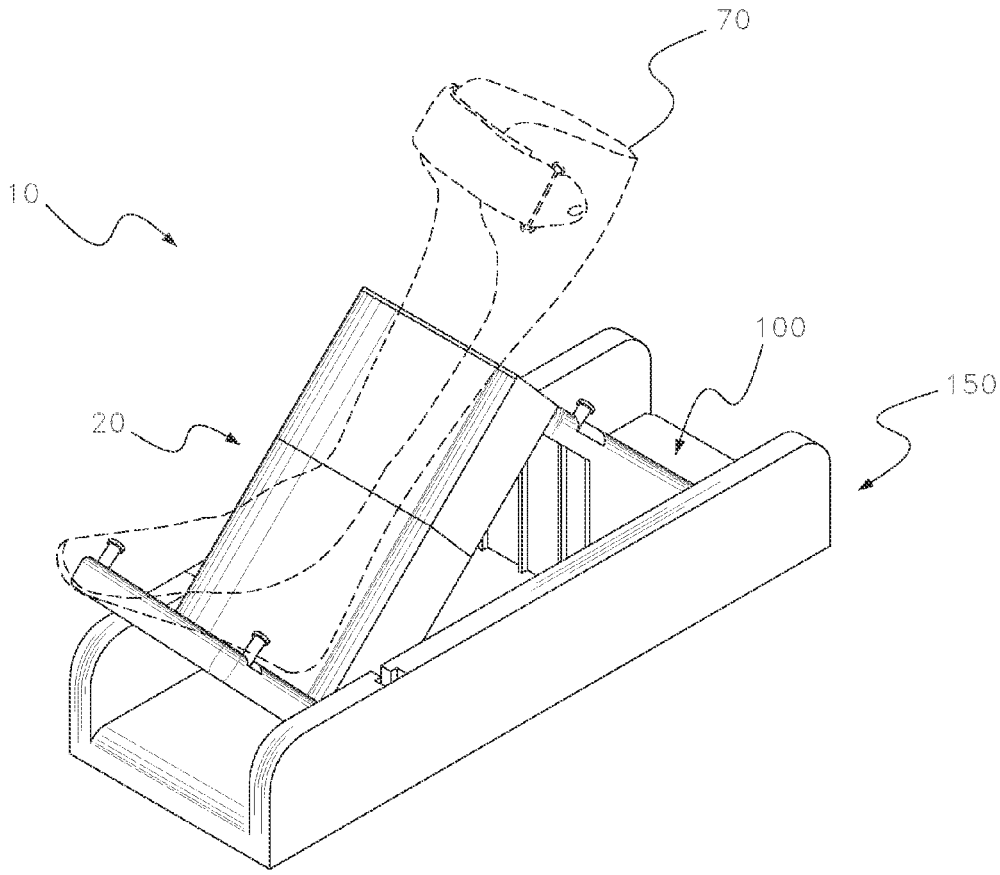
FIG. 11 is a perspective view of the AFO and shoe donning device assembly of FIG. 1 showing an AFO in place illustrating the AFO cradle at a 45 degree angle with respect to the docking base.
Figure 12:
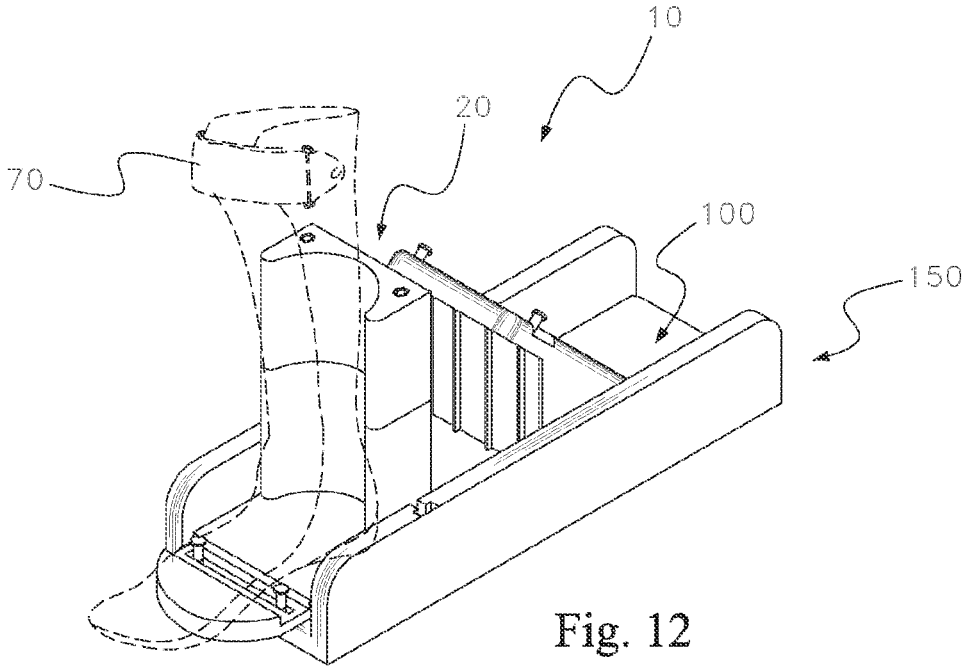
FIG. 12 is a perspective view of the AFO and shoe donning device assembly of FIG. 1 showing an AFO in place illustrating the AFO cradle at a 90 degree angle with respect to the docking base.
Figure 13:
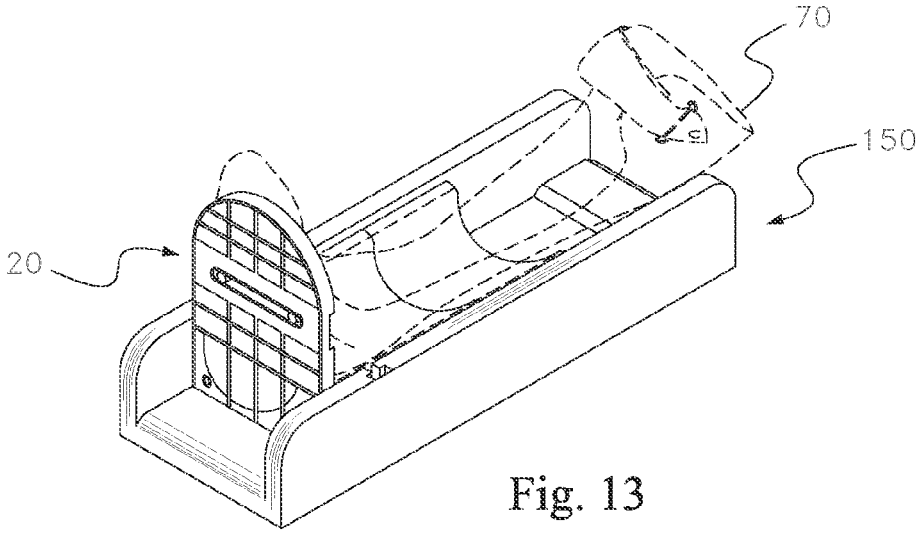
FIG. 13 is a perspective view of the AFO and shoe donning device assembly of FIG. 1 showing an AFO in place illustrating the AFO cradle laying down in to the docking base.

Referring now to FIGS. 3-10, the AFO cradle 20 is substantially L-shaped for placement of a correspondingly L-shaped AFO 70. The AFO cradle 20 includes a vertical concave front surface 26 and a horizontal upper surface 40 that extends outwardly from the vertical concave front surface 26 into which the calf portion of the AFO 70 rests for donning. As shown in FIGS. 11-13, an AFO is generally shaped to fit and to be worn around a patient's calf, ankle and foot and includes a convex outer rear vertical surface that can be placed into the AFO vertical concave front surface 26 as well as a foot part that is placed onto the upper horizontal surface 40 of the AFO cradle 20.

The AFO cradle 20 is generally comprised of a top portion 22 and a bottom potion 24 that are secured with respect to each other by means of attachment bolts 36 that threadingly engage with attachment bolts nuts 37 within the bolt channels 58. The attachment bolts 36 are comprised of standard hexagonal bolts of sufficient length to be slidingly engaged through the top portion 22 into the bottom portion 24 on respective sides and secured via openings in from the bottom surface 34 by means of the attachment bolts nuts 37. It can be understood by persons of skill in the art that the AFO cradle 20 could alternatively be manufactured as a unitarily molded single piece.

When the top portion 22 and a bottom potion 24 are affixed to each other, the AFO cradle 20 includes an upper top surface 32 and an upper foot surface 40 on which the foot portion of an AFO rests, a bottom surface 34 opposite the top surface 32 and the upper foot surface 40, front vertical edges 45, a U-shaped vertical concave front surface 26, a front arcuate wall 46 at a distal edge of the upper foot surface 40, a rear surface 30 opposite the front surfaces, a shoe platform block 28 unitarily molded onto the rear surface 30, a left side surface 44, and a right side surface 48 opposite thereto.

Still referring to FIGS. 3-10, the AFO cradle 20 includes hinge pins 52 configured at the rear distal corners of the left side surface 44 and the right side surface 48 respectively which are unitarily molded onto the AFO cradle 20. The hinge pins 52 are substantially T shaped in cross section and are designed to slidingly and pivotably engage with hinge pin channels 160 of the docking base 150.

Figure 5:
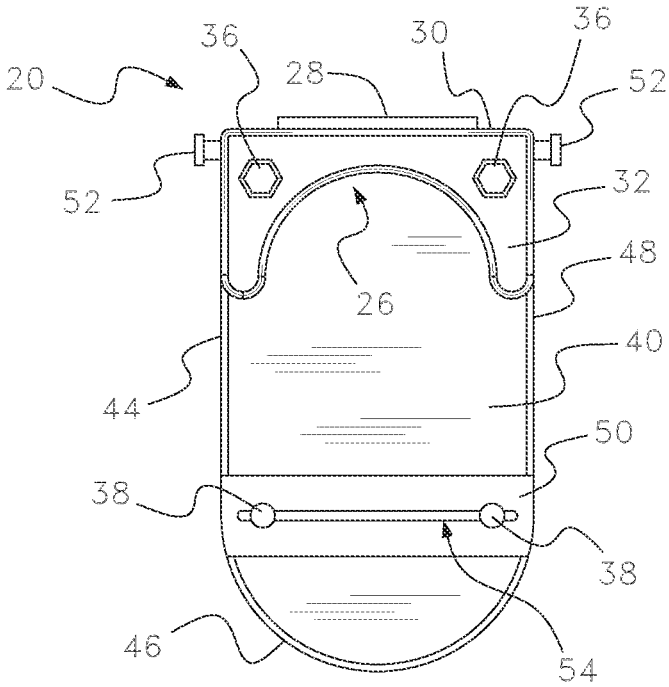
FIG. 5 is a top plan view of the AFO cradle.

Referring to FIG. 5, an adjustable pin slot 54 is disposed within a slot channel 50 toward the front rounded surface 46 of the AFO cradle 20. The adjustable pin slot 54 provides an open channel that is designed for releasable and sliding engagement with adjustable pins 38. The slot channel 50 extends across the lateral axis of the upper foot surface 40 from the left side 44 to the right side 48 of the AFO cradle 20 forming a trough. The adjustable pin slot 54 also extends across the lateral axis of the upper foot surface 40 and is further disposed along the centerline of the slot channel 50. The adjustable pin slot 54 is configured to have essentially an elongated elliptical shape whose aperture is configured to be of a size through which adjustable pin screws 39 can pass for threadingly engaging with the adjustable pin covers 41.

Still, referring to FIG. 5, the AFO cradle 20 includes an upper top surface 32 and the upper foot surface 40. The upper top surface 32 is substantially U-shaped forming the concave front surface 26 for reception of the AFO. Referring also to FIG. 10, the tops of the attachment bolts 36, which are hexagonally shaped, can be seen within the bolt channels 58 at the corners of the upper top surface 32.

Figure 4:
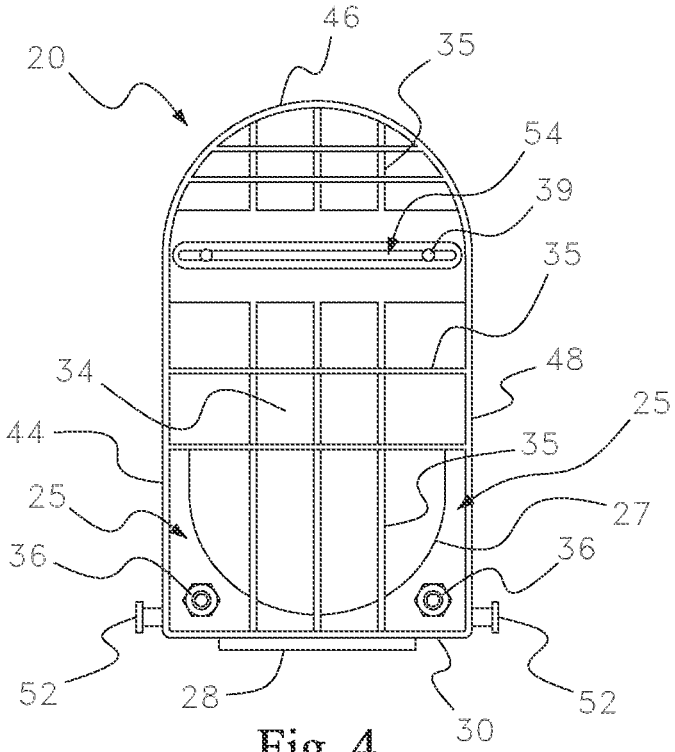
FIG. 4 is a bottom plan view of the AFO cradle.

Referring now to FIG. 4, the bottom surface 34 of the AFO cradle 20 includes a plurality of bottom ribs 35 that are configured in a substantially criss-crossing pattern in generally the forward half of the bottom surface 34. The rearward half of the bottom surface 34 includes a cavity space 25 between the rear surface 30 and a lower surface 27 that is formed from the bottom of the concave formation of the upper surface 40. The adjustable pin slot 54 can be seen to pass through the bottom surface 34.

Figure 6:
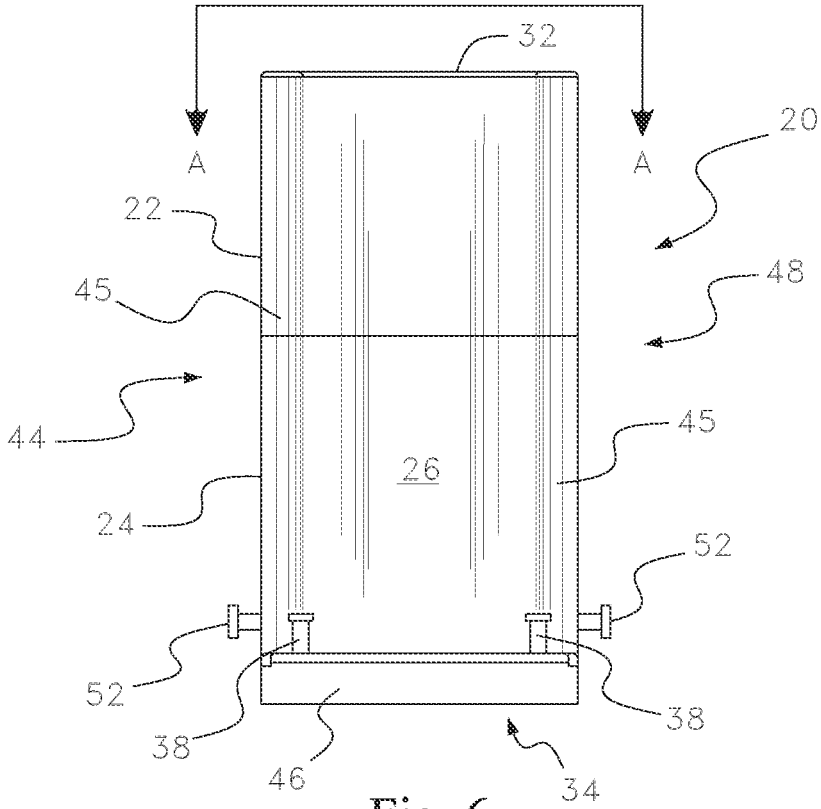
FIG. 6 is a front elevational view of the AFO cradle.

Referring now to FIG. 6, a front view of the assembled AFO cradle 20 is shown to include the top portion 22 and bottom portion 24, concave front surface 26, rounded front surface 46, and front vertical front walls 45. Disposed near the lower distal edges of the bottom portion 24 hinge pins 52 are included that are substantially T shaped in cross-section and disposed to project outwardly from either side 44, 48. When in place within the adjustable pin slot 54 of the AFO cradle 20, the adjustable pins 38 project substantially upwardly from the upper foot surface 40.

Figure 7:
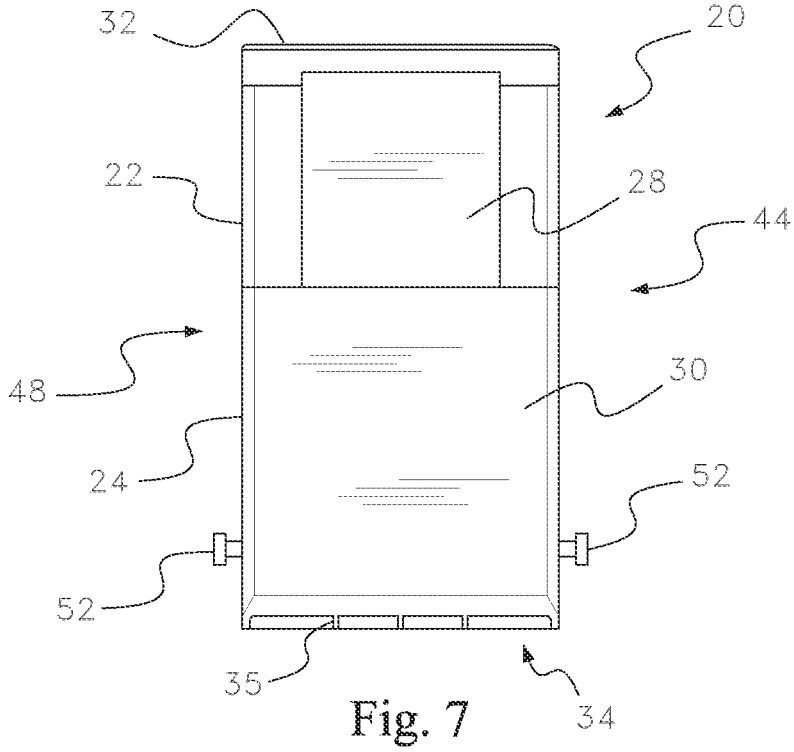
FIG. 7 is a rear elevational view of the AFO cradle.

Referring now to FIG. 7, the rear surface 30 of the AFO cradle 20 is shown to be substantially rectangular. The rear surface 30 includes a shoe platform block 28 which is unitarily molded onto the AFO cradle 20 disposed centrally toward the upper edge of the rear surface 30. The shoe platform block 28 is configured to be substantially square in area for engagement with the shoe platform 100 when the AFO and shoe donning device 10 is fully assembled.

Figure 8:
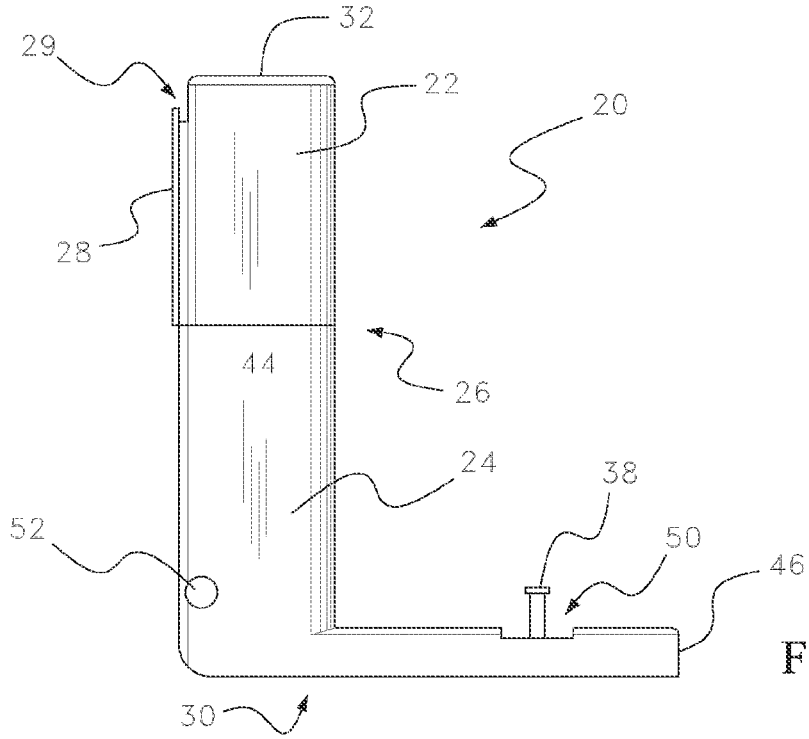
FIG. 8 is a left side elevational view of the AFO cradle.

Referring now to FIGS. 8 and 9, the left side surface 44 and right side surface 48 are essentially mirror images of each other and are substantially L shaped. The adjustable pin channel 50 can be seen to form troughs laterally along of the upper foot surface 40 and to extend from the left side surface 44 to the right side surface 48. The shoe platform block 28 is shown to include a top channel 29 that is designed to releasably engage with the slanted rear surface 111 of the shoe platform 100.

Referring now to FIG. 10, a cross-sectional view taken through line AA of FIG. 6 is shown. Bolt channels 58 are configured on opposite sides of the AFO cradle 20 forming a cavity within the front vertical walls 45. The bolt channels 58 extend from the top surface 32 of the top portion 22 through the bottom potion 24 of the AFO cradle 20 as smooth, non-threaded open spaces. Attachment bolts 36 slidingly pass through the bolt channels 58 and for threading engagement with the attachment bolt nuts 37 to affix the top portion 22 to the bottom portion 24. The bolt channels 58 are designed with a circular cross-sectional size such that when the attachment bolts 36 and attachment bolts nuts 37 are engaged with each other within the bolt channels 58 they tend not to slide further within the bolt channels 58 unless an external force is applied.

FIGS. 11-13 more clearly illustrate the various angles in which the AFO cradle 20 can be positioned for donning the AFO 70. As shown in FIG. 11, the AFO cradle can be positioned in such a manner that the AFO 70 is essentially at a 45 degree angle with respect to the docking base 150. The 45 degree positioning is achieved by means of sliding the hinge pins 52 into the hinge channels 160 of the shoe platform 100, and rotating the AFO cradle 20 rearwardly so that engages with the shoe platform 100. A patient can then don the AFO comfortably from a short sitting position by using his or her agile arm and hand to lift his or her paralyzed leg over the top surface 32 of the AFO cradle 20, and more easily place the paralyzed leg into the AFO 70. Alternatively, as shown in FIG. 12, the AFO cradle 20 can also be pivotably rotated in the hinge pin channels 160 to be positioned at substantially 90 degrees with respect to the docking base 150 for a second short seated donning position. FIG. 13 illustrates a third possible position of the AFO cradle 20. In this method, the shoe platform 100 has been removed from the docking base 100, allowing the AFO cradle 20 to be rotated rearwardly so that it is allowed to lay essentially flat within and parallel to the docking base 150. In this manner, a patient can don the AFO from a long sitting position on a bed or on a floor.

Now referring to FIGS. 14-19, the shoe platform 100 of the preferred embodiment is shown to include a platform bottom surface 104, a platform top surface 108 opposite thereto, a platform left wall 124, a platform right wall opposite thereto 122, a platform front wall 109, and a platform rear wall 106 opposite thereto. The platform bottom surface 104, that is substantially planar and rectangular in cross-section, and is designed to releasably and matingly engage with the shoe platform channel 176 of the docking base 150. The shoe platform 100 includes a platform top surface 108, opposite the bottom platform surface 104 is configured so that is rises angularly from the front platform surface 109 upwardly toward the rear platform surface 106 at substantially 45 degrees with respect to the bottom surface 104. The top platform surface 108 also includes a top segment 126 that is divided from the rest of the platform top surface 108 by a shoe platform pin channel 114. The top segment 126 extends beyond the rearward edge of bottom surface 104 and includes a slanted lower surface 111 opposite the top segment 126 and a slanted rear surface 126.

Still referring to FIGS. 14-19, the platform front surface 109 is discontinuous from the platform bottom surface 104 due to the presence of a platform front notch 110 which is designed to allow for releasable mating with one edge of the shoe platform channel 176 of the docking base 150. When placed within the docking base 150, the platform bottom surface 104 fits into the platform channel 176 to provide for stability of the shoe platform 100 for donning.

Figure 20:
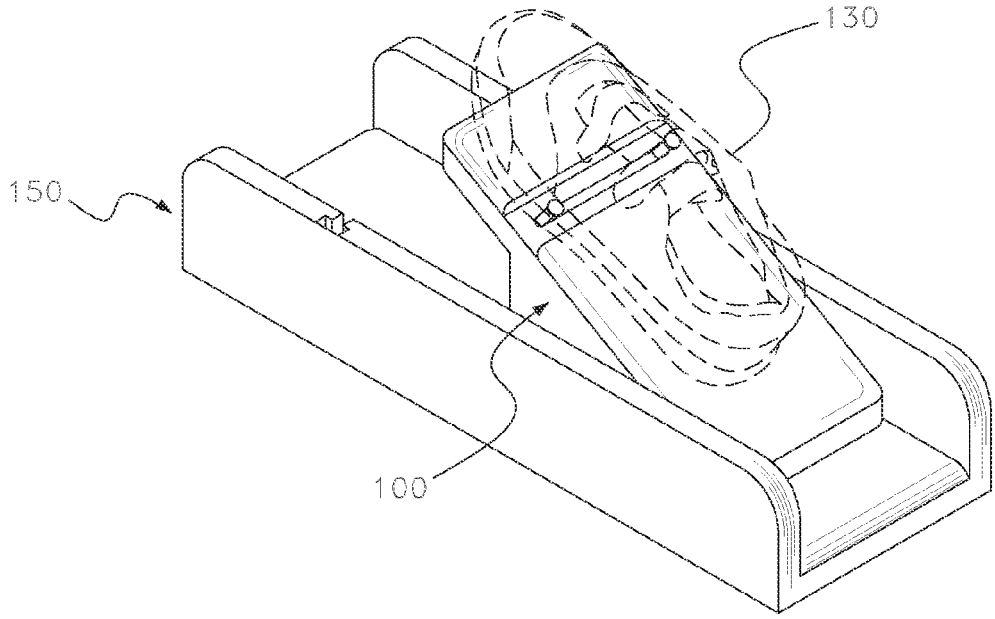
FIG. 20 is a perspective view of the shoe platform positioned in the docking base illustrating a shoe in position within the shoe platform.

As shown in FIG. 20, the platform top surface 108 allows for placement of a shoe 130 at a convenient, angled position with respect to the floor, for donning a shoe. Typically, a patient would also place the AFO cradle 20 into the docking base 150 to further prevent the shoe platform 100 from inadvertently shifting in the docking base 150 during the donning process. When a patient pushes his or her foot into a shoe, the shoe platform 100 may be pushed against the AFO cradle 20 which provides resistance to the force of the shoe platform 100 due to the engagement of the shoe platform block 28 of the AFO cradle 20 with the shoe platform 100.

Figure 14:
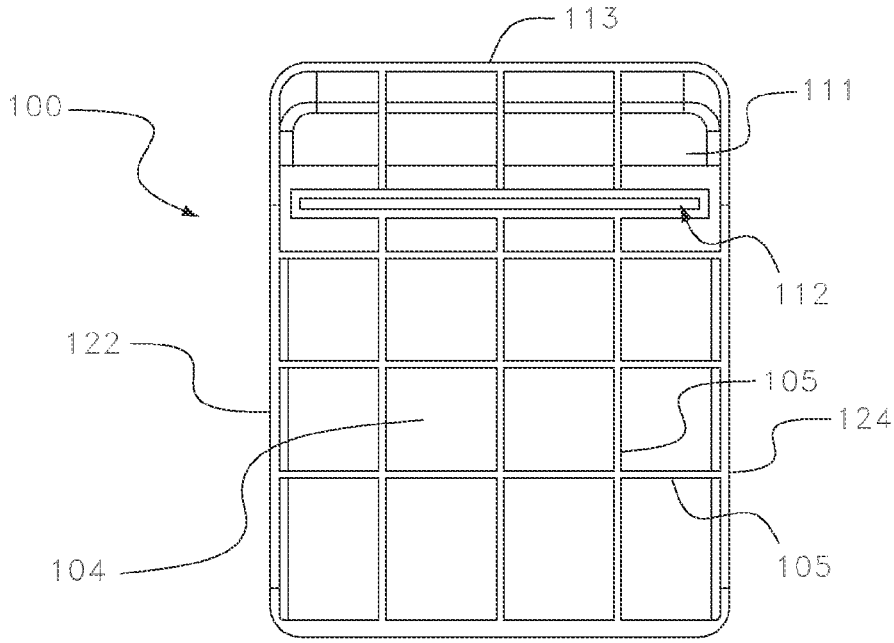
FIG. 14 is a bottom plan view of the shoe platform.

As shown in FIG. 14, the bottom surface 104 of the shoe platform 100 includes a plurality of shoe platform bottom ribs 105. The platform ribs 105 are configured in a substantially criss-cross pattern across the platform bottom surface 104.

Figure 15:
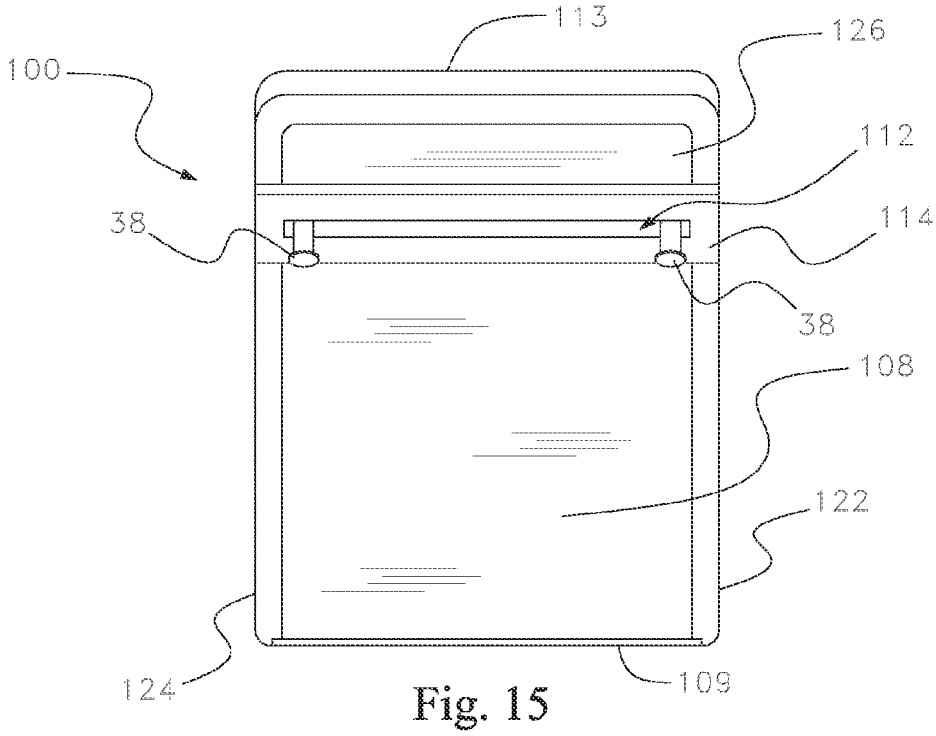
FIG. 15 is a top plan view of the shoe platform.
Figure 16:
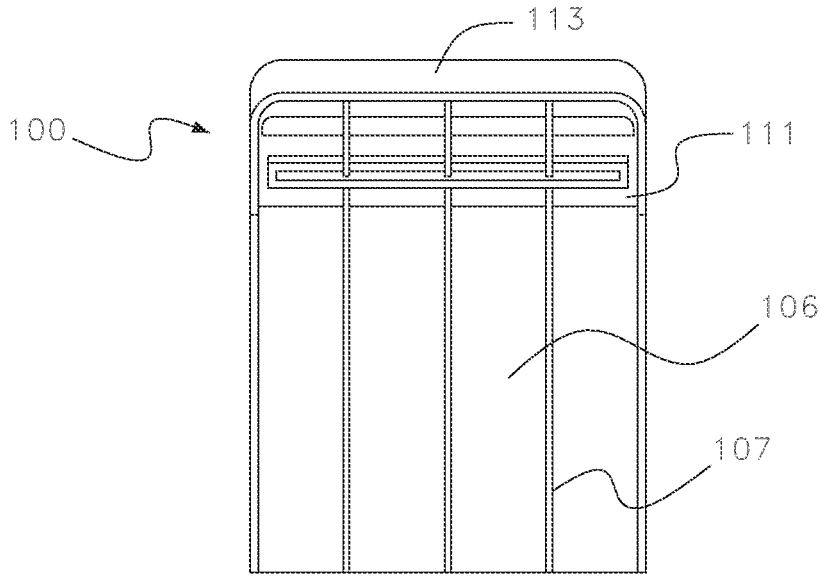
FIG. 16 is a rear elevational view of the shoe platform.
Figure 17:
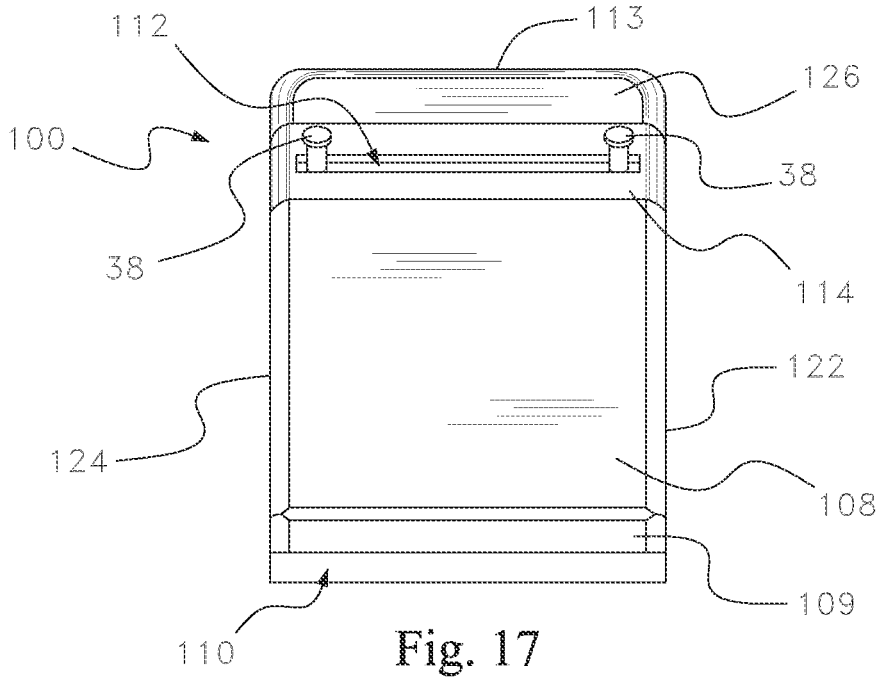
FIG. 17 is a front elevational view of the shoe platform.
Figure 18:
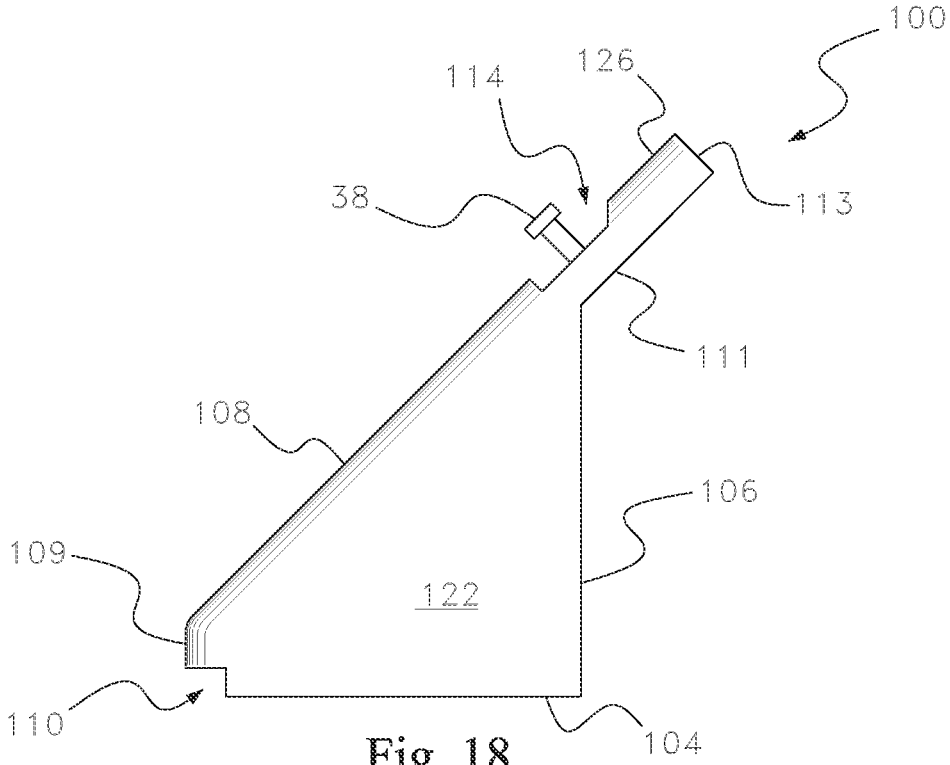
FIG. 18 is a right side elevational view of the shoe platform.
Figure 19:
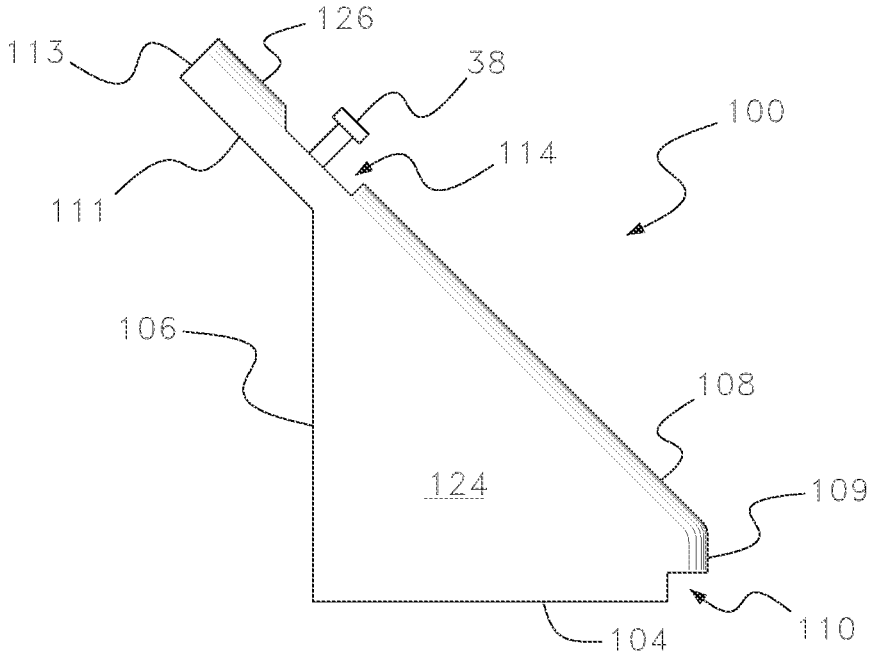
FIG. 19 is a left side elevational view of the shoe platform.

Referring now to FIGS. 15-17, the top platform surface 108 of the shoe platform 100 includes the shoe platform pin channel 115 which is designed to extend from the left side 124 to the right side 122 and to include a shoe pin slot 112 into which the adjustable pins 38 are releasably placed. The shoe pin slot 112 is essentially an elongate cavity of elliptical shape. As shown more clearly in FIGS. 18-19, the platform rear surface 106 extends upwardly from the lower surface 104 to meet the slanted lower surface 111 of the top segment 126, and includes a plurality of vertically disposed rear surface ribs 107.

Referring now to FIGS. 21-26, the docking base 150 of the present invention is shown to provide an elongated substantially U-shaped trough that is formed from the combination of the docking base top surface 170, inner surface walls 172 of the docking base left and right side walls 155, 157, and docking base top surfaces 168. The docking base side walls 155, 157 also include a docking base outer left surface wall 156 with docking base rounded top 168 and a outer right surface wall 158 with docking base rounded top 168 respectively. The docking base left and right side walls 155, 157 and the docking base top surface extending from the docking base front surface 152 to the docking base rear surface 154 to form the U-shaped trough.

Figure 21:
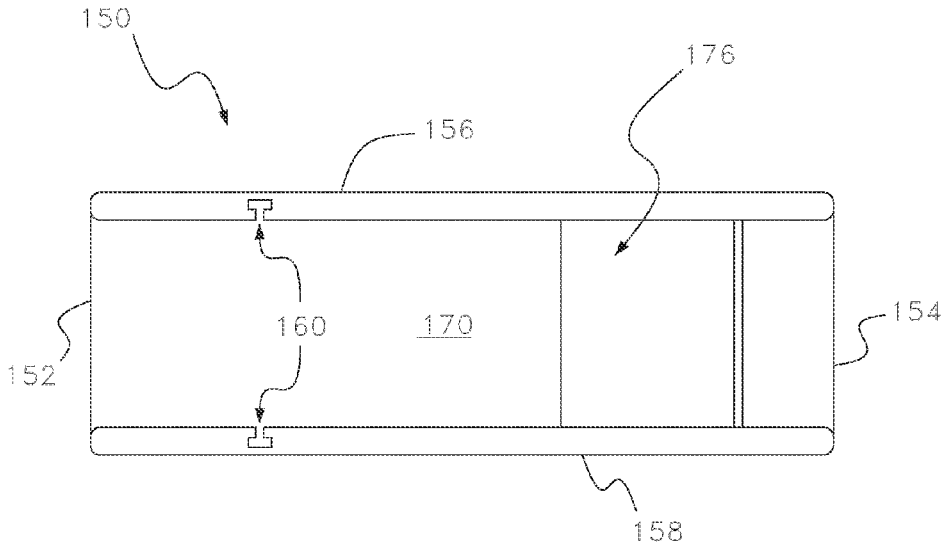
FIG. 21 is a top plan view of the docking base.

Referring to FIG. 21, the docking base top surface 170 is substantially rectangular and planar. Located approximately half way between the midline of the docking base top surface 170 and the docking base rear surface 154, the docking base top surface 170 includes a shoe platform channel 176 which is shaped and configured to receive the platform bottom surface 104 of the shoe platform 100.

Figure 22:
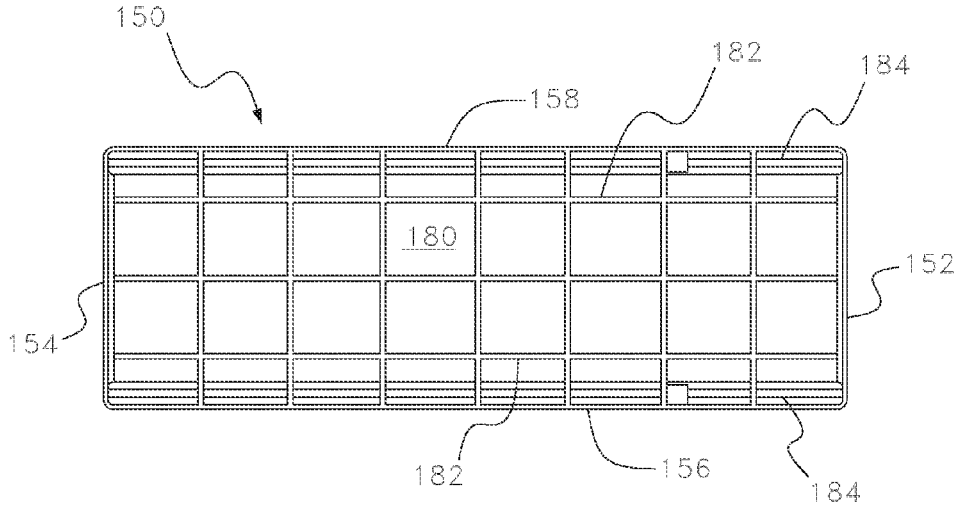
FIG. 22 is a bottom plan view of the docking base.
Figure 23:
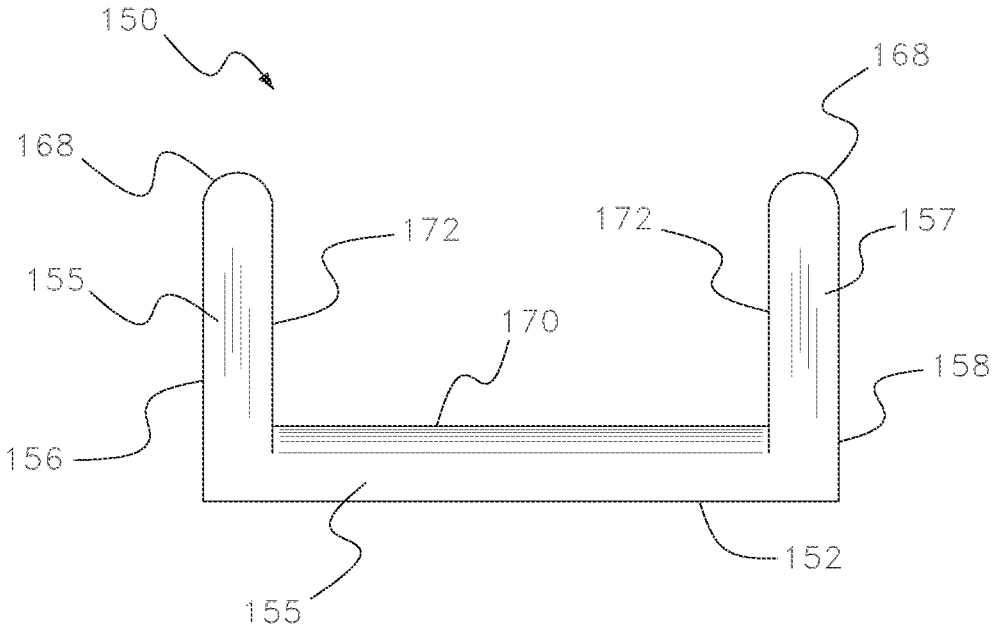
FIG. 23 is a front elevational view of the docking base.
Figure 24:
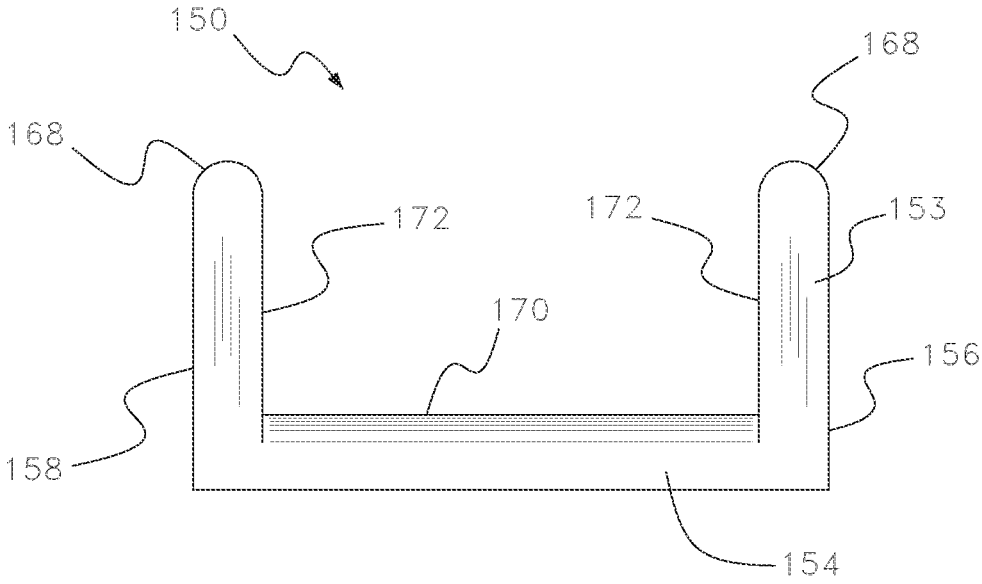
FIG. 24 is a rear elevational view of the docking base.
Figure 25:
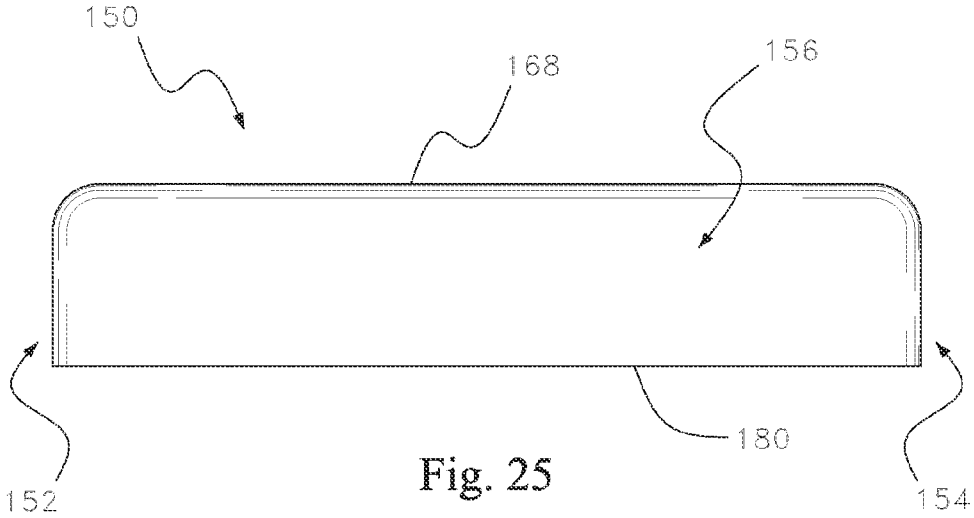
FIG. 25 is a right side elevational view of the docking base.
Figure 26:
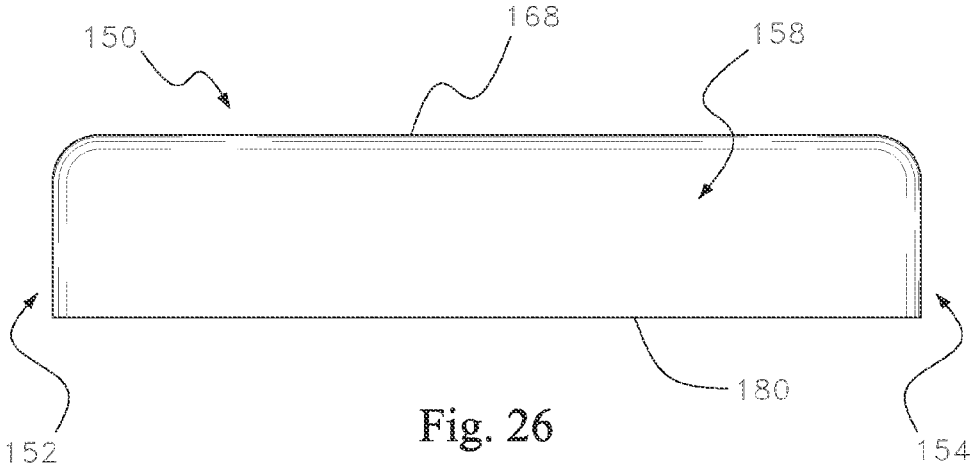
FIG. 26 is a left side elevational view of the docking base.

As shown in FIG. 22, the docking base bottom surface 180, opposite the docking base base upper surface 170, is substantially rectangular and planar and includes a plurality of docking base ribs 182 placed in a criss-crossing pattern across the base bottom surface 180. The docking base bottom surface 180 also includes reinforcing ridges 184 that extend longitudinally from the docking base front surface 152 to the docking base rear surface 154 and which are disposed toward the docking base left surface wall 156 and the docking base right surface wall 158.

Figure 27:
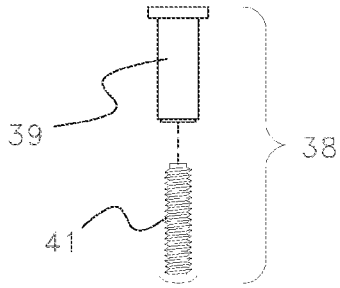
FIG. 27 is an exploded view of the adjustable pins of the AFO and shoe donning device assembly of FIG. 1.

Both the AFO cradle 20 and the shoe platform 100 are designed to include adjustable pins slots 54, 112 respectively for engagement with adjustable pins 38. As shown more clearly in FIG. 27, each adjustable pin 38 is comprised of a conventional screw 39 fitted within a neoprene bushing 41. The adjustable pins 38 affix releasably into the adjustable pins slots 54, 112 by simple means of threadingly attaching the screw upwardly through the bottoms of the adjustable pins slots 54, 112 into the bushings 41 until loosely secure therein. The patient can then slidingly move the adjustable pins 38 within the adjustable pins slots 54, 112 to accommodate varying AFO and shoe sizes.

While there has been described the preferred embodiment of this invention, it will be obvious to those skilled in the art that various other embodiments, changes, equivalents, and modifications may be made therein without departing from the spirit of scope of this invention. It is therefore aimed to cover all such changes, equivalents, and modifications as fall within the spirit and scope of the invention. For example, different kinds of adjustable pins could be employed or the AFO cradle could be made from a single unitarily molded piece. Moreover, the hinge pins of the AFO cradle could be detachable and affixed to the AFO cradle by means of threaded screws and apertures.

The invention is not limited in its application to the details of construction and to the arrangements of the components set forth in the description above or illustrated in the drawings. The invention is capable of other embodiments and of being practiced and carried out in various ways. It is to be understood that the terminology employed herein is for the purpose of the description and should not be regarded as limiting.

We claim:

1. An ankle foot orthosis and shoe donning apparatus comprising:

a cradle for placement of an ankle foot orthosis, said cradle forming a substantially concave L-shaped channel having a vertical portion and a horizontal portion, wherein said cradle includes a plurality of hinge pins disposed on said horizontal portion wherein said hinge pins are substantially T-shaped in cross section;

and a docking base wherein said docking base includes hinge channels designed and configured for sliding and rotatable engagement with said hinge pins of said cradle wherein said hinge channels of said docking base are substantially T-shaped in cross section section and are designed and configured so that said cradle can be rotated within said docking base at a variety of positions for donning by pivotal and sliding engagement of said hinge pins of said cradle within said hinge channels and wherein said docking base forms a substantially U-shaped elongated channel for releasable engagement with said cradle, wherein said docking base is further comprised of a docking base top surface, a docking base bottom surface opposite thereto, a docking base left wall, a docking base right wall opposite thereto, a docking base front surface and a docking base rear surface.

2. An ankle foot orthosis donning apparatus according to claim 1, wherein said cradle includes a cradle bottom surface and a cradle top surface opposite thereto, wherein said cradle bottom surface includes a plurality of cradle ribs, and wherein said cradle top surface includes an upper top portion and a lower top portion, wherein said upper top portion is substantially U-shaped, and wherein said cradle has a left cradle wall and a right cradle wall opposite thereto, and a first front wall disposed at a forwardly distal edge of said horizontal portion, and a second front wall that forms said concave L-shaped channel of said vertical portion, and a cradle rear wall opposite said first front wall and said second front wall.

3. An ankle foot orthosis donning apparatus according to claim 2, wherein said cradle includes an elongated open cradle slot disposed proximally toward said first front wall of said horizontal portion wherein said elongated open cradle slot extends from said left cradle wall to said right cradle wall, and further comprising cradle pins that slidingly engage within said elongated open cradle slot to accommodate various sizes of said ankle foot orthosis.

4. An ankle foot orthosis donning apparatus according to claim 2 wherein said cradle rear wall includes a plurality of cradle rear ribs.

5. An ankle foot orthosis donning apparatus according to claim 2 wherein said vertical portion and said horizontal portion of said cradle include a plurality of bolt channels for joining said vertical portion to said horizontal portion, wherein said plurality of said bolt channels are annular in cross-section and formed of a unthreaded inner walls that extend from said cradle upper top portion to said cradle bottom surface and whereby said vertical portion and said horizontal portion of said cradle are affixed to each other by means of attachment bolts and attachment nuts wherein said attachment bolts threadingly engage with said attachment nuts within said bolt channels.

6. An ankle foot orthosis donning apparatus according to claim 2 wherein said vertical portion of said cradle rear wall is substantially planar.

7. An ankle foot orthosis donning apparatus according to claim 1, wherein said docking base bottom surface includes a plurality of docking base ribs.

8. An ankle foot orthosis and shoe donning apparatus comprising:

a cradle for placement of an ankle foot orthosis, said cradle forming a substantially concave L-shaped channel having a vertical portion and a horizontal portion, wherein said cradle includes a plurality of hinge pins disposed on said horizontal portion;

a shoe platform having a substantially planar, square shaped platform bottom surface and an inclined platform top surface opposite thereto, wherein said inclined platform top surface forms a substantially 45 degree angle with said platform bottom surface for placement of a shoe, a platform left wall and a platform right wall opposite thereto, a platform front surface and a platform rear surface, wherein said platform rear surface is disposed proximally adjacent to said vertical portion of said cradle when assembled; and a docking base wherein said docking base includes hinge channels designed and configured for sliding and rotatable engagement with said hinge pins of said cradle and wherein said docking base also includes a shoe platform trough that is designed and configured to releasably and matingly engage with said bottom surface of said shoe platform.

9. An ankle foot orthosis and shoe donning apparatus according to claim 8 wherein said hinge pins are substantially T-shaped in cross section.

10. An ankle foot orthosis and shoe donning apparatus according to claim 8, wherein said cradle includes a cradle bottom surface and a cradle top surface opposite thereto, wherein said cradle bottom surface includes a plurality of cradle ribs, and wherein said cradle top surface includes an upper top portion and a lower top portion, wherein said upper top portion is substantially U-shaped, and wherein said cradle has a left cradle wall and a right cradle wall opposite thereto, and a first front wall disposed at a forwardly distal edge of said horizontal portion, and a second front wall that forms said concave L-shaped channel of said vertical portion, and a cradle rear wall opposite said first front wall and said second front, wall.

11. An ankle foot orthosis and shoe donning apparatus according to claim 10, wherein said cradle includes an elongated open cradle, slot disposed proximally toward said first front wall of said horizontal portion wherein said elongated open cradle slot extends from said left cradle wall to said right cradle wall, and further comprising cradle pins that slidingly engage within said elongated open creole slot to accommodate various sizes of said ankle foot orthosis.

12. An ankle foot orthosis and shoe donning apparatus according to claim 10 wherein said cradle rear wail includes a plurality of cradle rear ribs.

13. An ankle foot orthosis and shoe donning apparatus according to claim 10 wherein said vertical portion and said horizontal portion of said cradle include a plurality of bolt channels for joining said vertical portion to said horizontal portion, wherein said plurality of said bolt channels are annular in cross-section and formed of unthreaded inner walls that extend from said cradle upper top portion to said cradle bottom surface and whereby said vertical portion and said horizontal portion Of said cradle are affixed to each other by means of attachment bolts and attachment nuts wherein said attachment bolts threadingly engage with said attachment nuts within said bolt channels,

14. An ankle foot orthosis and shoe donning apparatus according to claim 10 wherein said vertical portion of said cradle rear wall is substantially planar and further includes a unitarily molded shoe platform block disposed proximally toward the upper edge of said cradle rear wall.

15. An ankle foot orthosis and shoe donning apparatus according to claim 8, wherein said shoe platform includes elongated men platform slot disposed proximate toward an upper distal edge of said platform top surface and further comprising shoe platform pins that slidingly engage within said elongated open platform slot of said shoe platform to accommodate various sizes of said shoes, wherein each of said platform pins are comprised of a screw and a bushing wherein said screw threadingly engages with said bushing within said open platform slot.

16. An ankle foot orthosis and shoe donning apparatus according to claim 8, wherein said platform rear surface of said shoe platform includes a plural of platform rear ribs and said platform bottom surface of said shoe platform includes a plurality of platform bottom ribs.

17. An ankle foot orthosis and shoe donning apparatus according to claim 15, wherein said upper distal edge of said platform top surface of said shoe platform extends beyond said platform bottom surface of said shoe platform forming a lip for engagement with said vertical portion of said cradle.

18. An ankle foot orthosis and shoe donning apparatus according to claim 8, wherein said docking base forms a substantially U-shaped elongated channel for releasable engagement with said cradle and said shoe platform, wherein said docking base is further comprised of a docking base top surface, a docking base bottom surface opposite thereto, a docking base left wall, a docking right wall opposite thereto, a docking base front surface and a docking base rear surface.

19. An ankle foot orthosis and shoe donning apparatus according to claim 8, wherein said hinge channels of said docking base are substantially T-shaped in cross section and are designed and configured so that said cradle can be rotated within said docking base by pivotal and sliding engagement of said hinge pins of said cradle within said hinge channels.

20. An ankle foot orthosis and shoe donning apparatus according to claim 14, wherein said docking base bottom surface includes a plurality of docking base ribs.

* * * * *